US008109778B2

(12) United States Patent
Howard et al.

(10) Patent No.: US 8,109,778 B2
(45) Date of Patent: Feb. 7, 2012

(54) ELECTRICAL CONNECTOR LOCK

(76) Inventors: Jeff Joseph Howard, St. Bernard, LA (US); David Michael Jackson, St. Bernard, LA (US)

( * ) Notice: Subject to any disclaimer, the term of this patent is extended or adjusted under 35 U.S.C. 154(b) by 0 days.

(21) Appl. No.: 12/798,628

(22) Filed: Apr. 8, 2010

(65) Prior Publication Data

US 2011/0250779 A1 Oct. 13, 2011

(51) Int. Cl.
*H01R 13/625* (2006.01)

(52) U.S. Cl. ..... 439/346

(58) Field of Classification Search ..... 439/346
See application file for complete search history.

(56) References Cited

U.S. PATENT DOCUMENTS 2,903,669 A 4/1956 Gilman et al.
4,136,919 A * 1/1979 Howard et al. ..... 439/346
5,352,132 A 10/1994 O'Keefe et al.
5,427,543 A 6/1995 Dynia
5,755,588 A 5/1998 Sweatman et al.
6,234,823 B1 5/2001 Fuess
2005/0079751 A1 4/2005 Decker
2005/0153592 A1 7/2005 O'Keefe et al.
2010/0068918 A1 3/2010 Alamii

* cited by examiner

*Primary Examiner* — Ross Gushi
(74) *Attorney, Agent, or Firm* — Keaty Law Firm LLC

(57) ABSTRACT

A locking assembly for selectively locking a female electrical receptor with an electrical male plug connector is disclosed. The male plug has a plurality of prongs with apertures, and female receptor has prong-receiving contact members with openings that are aligned with the apertures when the plug is connected with the receptor. The locking assembly can have a pair of caps with conical projections that fit into the openings in the contact members and apertures of the prongs. A spring-loaded actuator button moves the caps in and out of engagement with the contact members and the prongs. Several embodiments of the locking assembly are disclosed.

13 Claims, 7 Drawing Sheets

70
60
58
37
62
72
64

60
58
37
64
68

37
60
61
64
68
74
72
62

37
60
64
70
53
54
66

60
37
64
66
37
53

ELECTRICAL CONNECTOR LOCK

BACKGROUND OF TILE INVENTION

This invention relates to electrical connectors and, more particularly, to an electrical cord plug assembly for use in preventing the separation of joined electrical plug and electrical socket.

Electrical cord connector assemblies consisting of a male connector, or plug, and a female connector, or socket, are conventionally used in a multitude of industrial and household applications. Both male connectors and female connectors are connected to a discrete length of cord of cable to provide an electrical connection between appliances, tools, sources of power, etc.

The male connector portion of such an assembly has a pair of electrically-conductive prongs and sometimes a ground prong. The socket part of the assembly includes a housing with corresponding openings to receive the prongs of the male connector portion. The housing is provided with electrical contacts for establishing electrical connection between the electrical devices, tools, and the like.

One of the major problems with conventional electrical connector assemblies is inability to secure the male connector portion in the housing and prevent the plug from being disconnected from the socket housing. Conventional assemblies establish only frictional engagement between the plug and the socket; a pulling force applied to the cable can and oftentimes does, disengage the plug from the socket. The pulling force may be applied inadvertently when moving an electrical device beyond the extent of the interconnected electrical conduit. Alternatively, children or pets may unintentionally disconnect these electrical connections.

One of the industry responses to the problem was provision of a box-like enclosure that is adapted for positioning about the plug and socket connectors and restricting lateral movement of the plug and the socket connector members. The box has a hinged lid that is locked by a flap engaging within a slot formed in the wall of the box. However, such solution is not without problems, such as difficulty in manipulation, especially for people with limited dexterity, extra bulk added to the connectors and the like.

The present invention contemplates elimination of drawbacks associated with conventional solutions and provision of an electrical connector lock for use with electrical assemblies having a pronged male connector portion.

SUMMARY OF THE INVENTION

It is, therefore, an object of the invention to provide an electrical connector lock configured for use with pronged male connectors.

It is another object of the invention to provide an electrical connector lock that is mounted substantially entirely within the housing of the female receptor.

It is a further object of the invention to provide an electrical connector lock that can be activated and deactivated by depressing actuator button(s) mounted on exterior of the housing of the female receptor.

These and other objects of the invention are achieved through a provision of a locking female electrical receptor assembly for use with an electrical male connector provided with electrically conductive prongs having punched or drilled apertures. The female receptor has a housing, an end face of which is provided with slots configured to receive the prongs of the male connector, or male plug. A pair of spaced-apart electrically conductive contact members are mounted in the housing in alignment with the slots, each of the contact members being provided with a channel sized and configured to receive a male prong therein. The contact members each have a transverse opening that is aligned with the aperture in the male plug prongs when the male connector is engaged with the female receptor.

A locking means is mounted in the housing for locking the male connector and the female receptor, the locking means being configured to move between a normally locked position extending through the openings of the contact members and an unlocked position away from the contact members. The locking means is configured to also extend through apertures of the prongs when the male connector is engaged with the female receptor. A depressible actuator means is operationally connected to the locking means for moving the locking means into an unlocked position. The actuator means can be one or more buttons accessible from exterior of the housing and spring-loaded for normally urging the locking means into a locked position. The actuator button can be activated by an actuator spring or by the tension of a leaf spring.

The locking means can be in the form of a pair of caps with conical projections that engage the openings in the contact members and the apertures in the prongs. The locking means can also be in the form of a U-shaped leaf spring with opposing spring leaf portions that carry projections. The projections engage the openings on the contact members and the apertures in the prongs to lock the male plug connector and the female receptor.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 2:
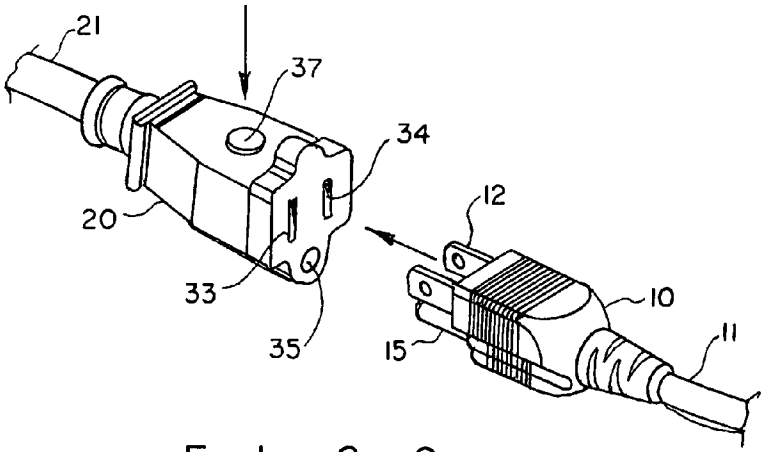
FIG. 2 is a perspective view illustrating engagement of the two connectors, while the locking member is depressed.
Figure 4:
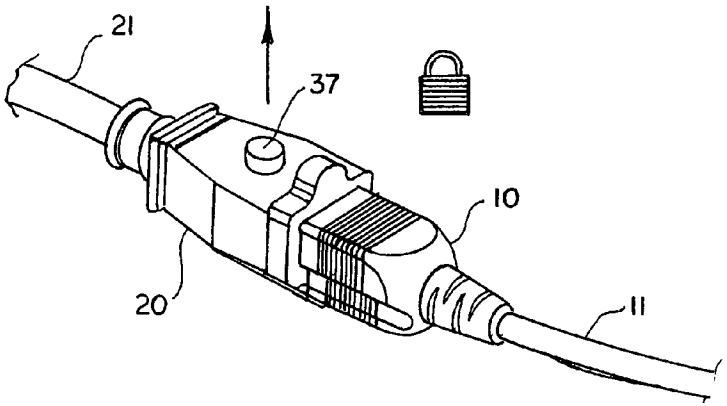
FIG. 4 illustrates the two electrical connectors in a locked position.
Figure 1:
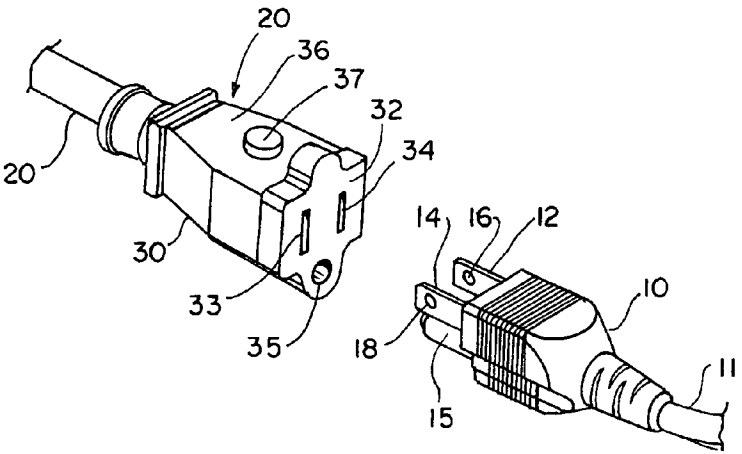
FIG. 1 is a perspective view of two electrical corded connectors, with the female connector carrying a locking member.
Figure 3:
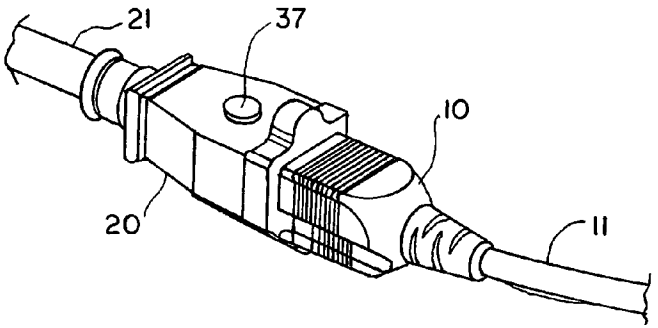
FIG. 3 is a perspective view illustrating engagement of the male and female connectors in an unlocked position.

Turning now to the drawings in more detail, and in particular to FIGS. 1-13, the first embodiment of the present invention can be seen in use with an electrical male connector plug 10 having conventional insulated electrical cord 11 and a plurality of outwardly conductive extended prongs 12 and 14, and a ground prong 15. The prongs 12 and 14 contain prong apertures 16 and 18, respectively. The locking assembly of the present invention is configured to lockingly engage the prong apertures 16, 18 when the male electrical cord plug 10 is inserted a predetermined distance within the female receptor 20 and prevent disengagement of the male connector plug 10.

Electrical female receptor 20 is connected to a typical electrical line or cord 21 having an exterior electrical insulation. The male plug 10 and female receptor 20 can be attached to any conductive electrical lines, such as in connection with extension cords to the insulated cords 11, 21.

The female receptor 20 is formed as a molded receptor housing 30 from a suitable material, such as a molded plastic and the like, that is electrically non-conductive. An end face 32 of the receptor 20 is provided with a pair of plug holes or slots 33, 34 and an slot 35 for the ground prong 15. An upper face 36 of the housing 30 is provided with an opening through which a locking assembly actuator button 37 extends. The operation of the locking assembly will be described in more detail hereinafter.

Figure 5:
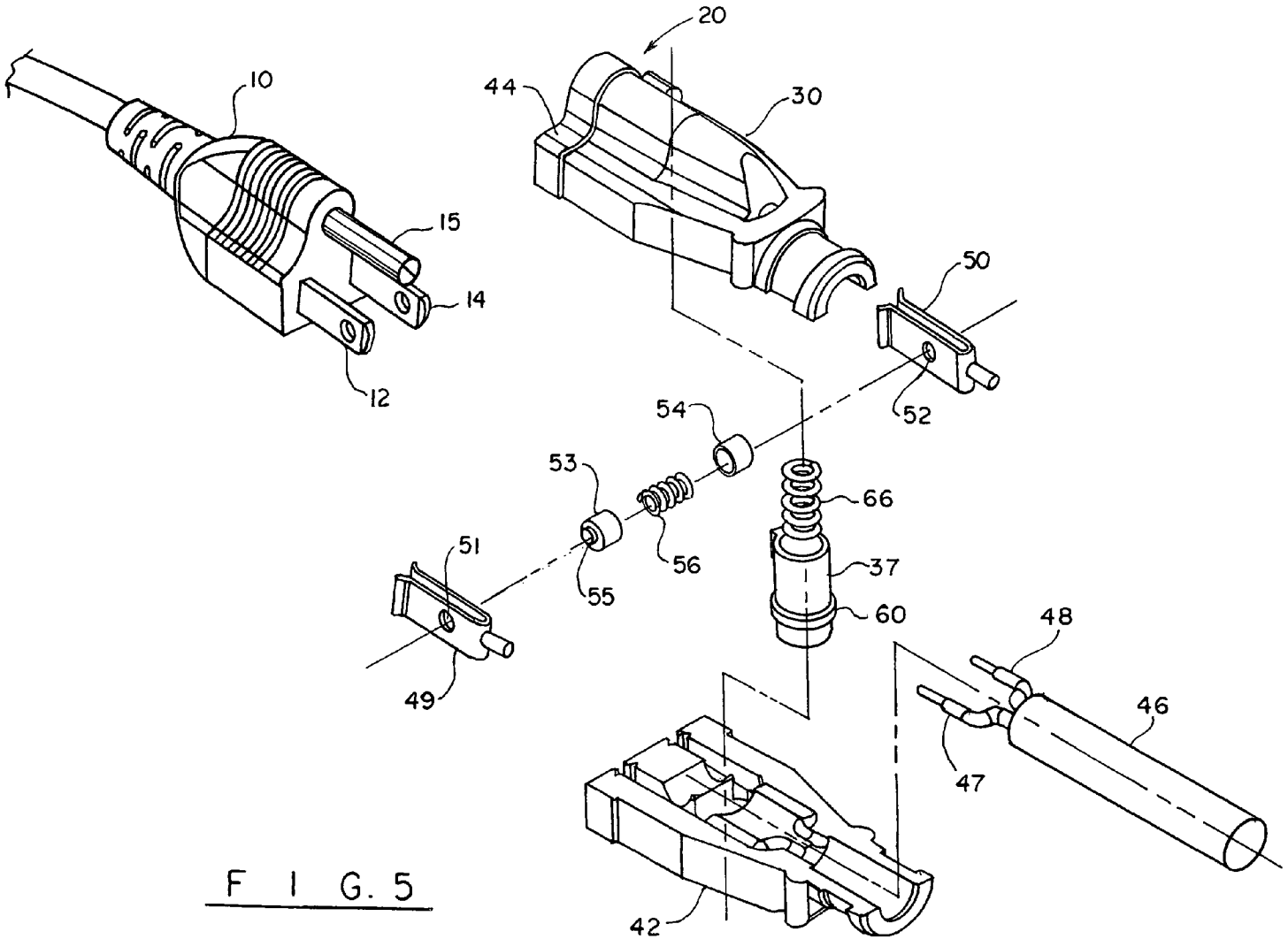
FIG. 5 is an exploded view of the female connector.

Turning now to FIG. 5, the female receptor 30 is shown in an exploded view. For ease of illustration, the housing 30 is shown comprising two halves, 41 and 42. A central slot 45 is formed in the housing 30 to receive an electrical cable 46 with wires 47, 48. The wires 47, 48 diverge and engage electrical contact members 49, 50, respectively. Each of the contact members 49, 50 is formed as a U-shaped body with a channel, which is configured to receive the prongs 12 and 14. The contact members 49, 50 are formed from an electrically-conductive material to allow electrical current to pass between the male connector 10 and the female receptor 20.

Figure 12:
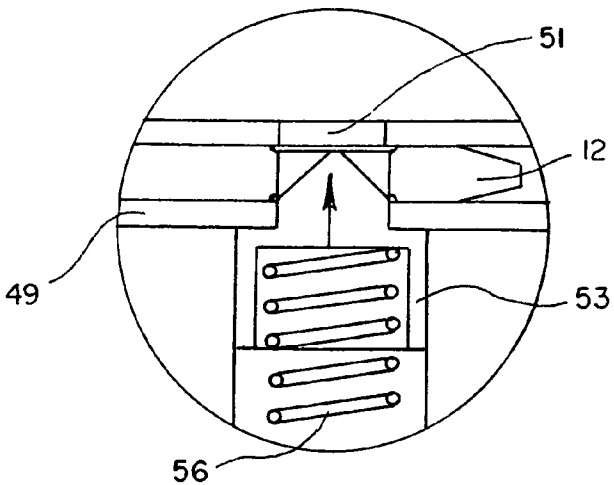
FIG. 12 is a schematic view illustrating movement of a prong of the male connector within the housing of the female connector, while the cap is in a locked position.
Figure 11:
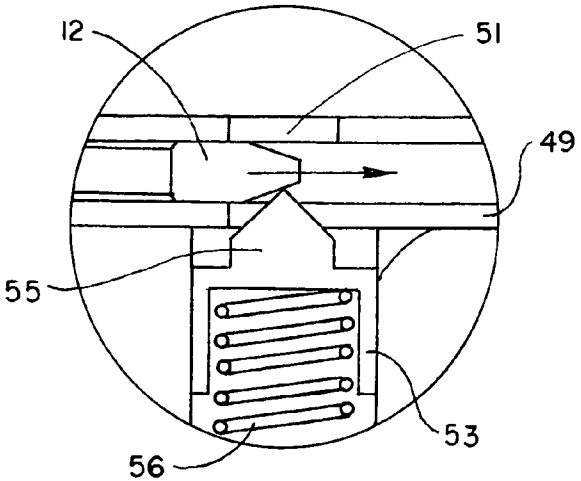
FIG. 11 is a schematic view illustrating movement of a prong of the male connector within the housing of the female connector, while the cap is in an unlocked position.
Figure 13:
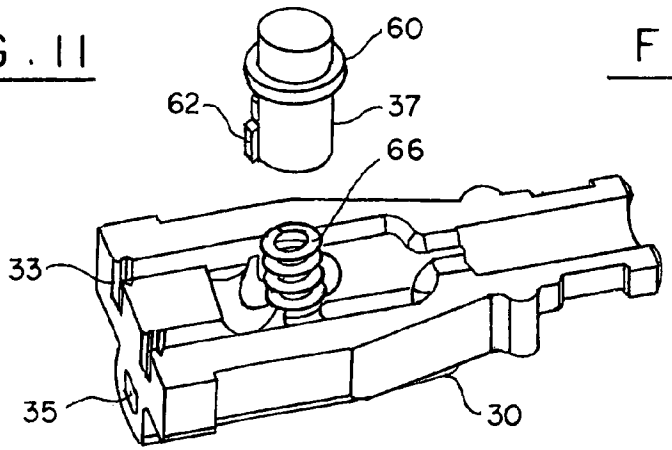
FIG. 13 is a perspective view of a portion of a female connector housing showing the depressible lock member and a main compression spring.

Each of the contact members 49, 50 is provided with a transverse opening 51, 52, respectively. A pair of cylindrical hollow caps 53, 54 is positioned between the contact members 49, 50. Each cap 53 and 54 comprises a conical portion 55, which extends outwardly from the cap body (see FIGS. 11 and 12). The conical portion 55 is sized and configured to extend through the openings 51, 52 of the contact members 49, 50 when the locking assembly is in a locked position. A compression spring 56 is mounted between the caps 53, 54, partially fitting inside the hollow bodies of the caps 53, 54, as shown in FIGS. 11 and 12.

Figures 6, 7, 8, 9, 10:
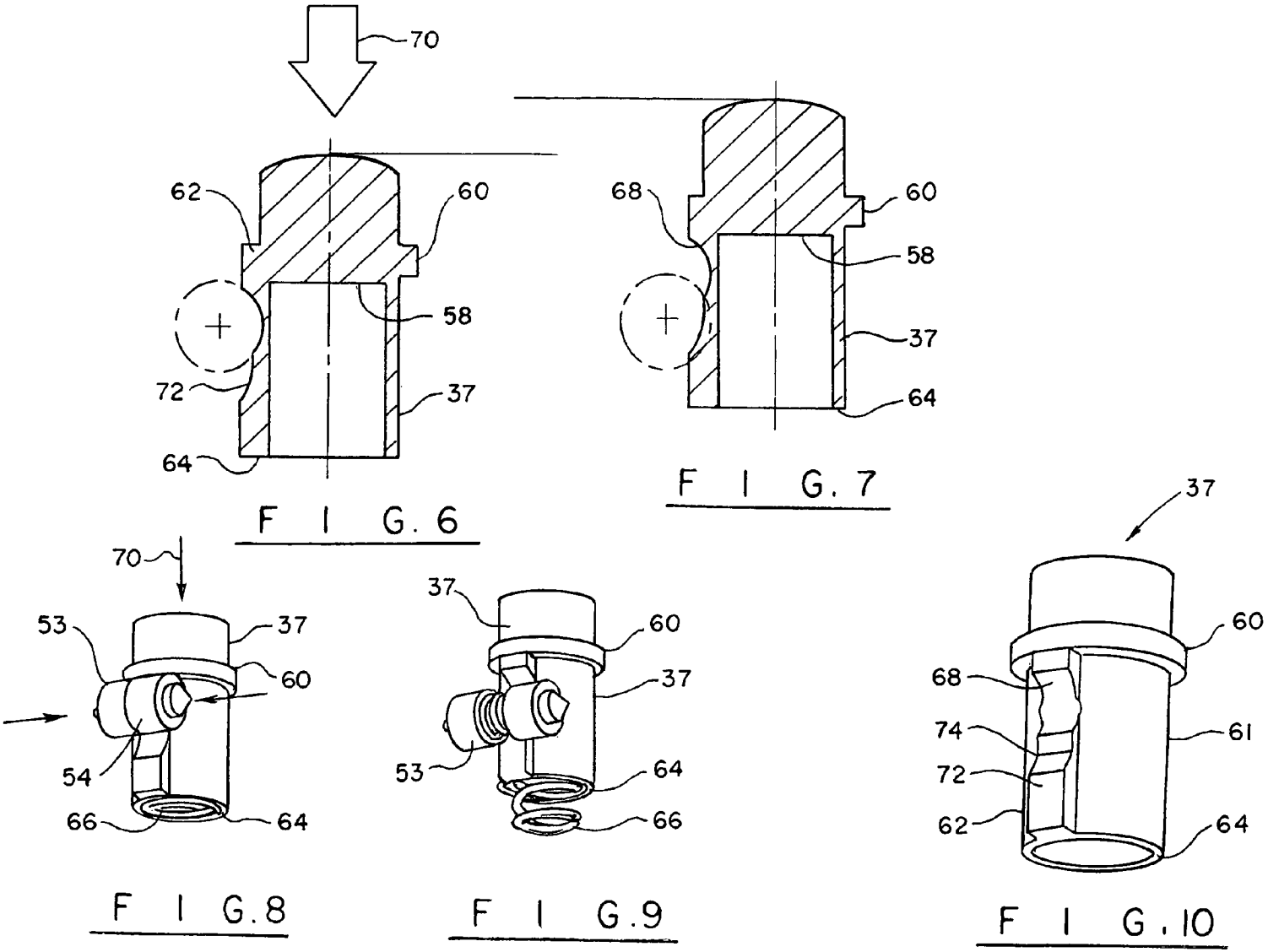
FIG. 6 is a cross sectional view of a depressible locking member, with the cap in an unlocked position.
FIG. 7 is a cross sectional view of a depressible locking member, with the cap in a locked position.
FIG. 8 is a perspective view of the locking member, with the caps in an unlocked position.
FIG. 9 is a perspective view of the locking member, with the caps in a locked position.
FIG. 10 is a perspective view of the depressible locking member.

The depressible locking assembly button 37 is mounted in the housing 30 and extends through the opening formed in the upper face 36. The button 37 comprises a generally cylindrical hollow body sized and configured to receive an actuating spring 66 therein. The actuating spring 66 urges, at one end against the housing 30, and at another end—against an inner shoulder 58 (FIGS. 5 and 7) formed in the interior of the button 37. If desired, the actuating spring 56 may be sized to almost entirely fit in the body of the button 37, as shown in FIG. 9.

The exterior of the button 37 is provided with an annular flange 60 that prevents the button 37 from disengaging from the housing 30. A locking bar 62 is affixed to an exterior surface 61 of the button 37, extending longitudinally along the length of the button 37, from an inner end 64 of the button 37 to the annular flange 60. The longitudinal axis of the locking bar 62 is perpendicular to the direction of movement of the caps 53, 54 when the caps move between locked and unlocked positions under the force of the compression spring 56.

The locking bar 62 is provided with a first groove 68 configured to frictionally engage the caps 53, 54 when the locking assembly is an unlocked position. As shown in FIGS. 6 and 8, when the caps 53, 54 are positioned in the groove 68, the button 37 can move axially in the direction of arrow 70 when depressed by a user. When the button 37 is depressed, the caps 53, 54 are close together and allow the prongs 12, 14 to move freely within the contact members 49, 50 (FIG. 11).

When the button 37 is released the caps 53, 54 are forced to move from the groove 68 along the locking bar 62. A second groove 72 is formed along the locking bar 62. An outwardly extending ridge 74 is formed between the first groove 68 and the second groove 72.

The ridge 74 forces the caps 53, 54 to separate, with the compression spring 56 keeping the caps 53, 54 apart (see, FIG. 9). At the same time, the actuating spring 66, being released from compression, forces the cap 37 outwardly from the housing 30, and the caps 53, 54 move into the second groove 72.

The conical portions 55 of the caps 53, 54 enter the openings 51, 52 formed in the contact members 49, 50 and are forced into the openings 16, 18 formed in the prongs 12 and 14, as shown in FIGS. 7 and 12. In this position, the male connector 10 cannot be disengaged from the female receptor 20, and the two corded connectors are lockingly engaged. When the user desires to disconnect the male connector from the female receptor the user presses on the button 37, causing the caps 53, 54 to retreat from engagement with the prongs 12 and 14 and move back into the first groove 68. In this position, the prongs 12 and 14 can move freely in the axial direction within the contact members 49, 50.

This embodiment of the invention requires that the button 37 be depressed by the user when the user wishes to engage the male connector plug with the female receptor. Once the button 37 is released it springs outwardly from the housing 30 and locks the caps 55 with the prongs 12, 14, thus preventing disengagement of the two corded electrical connectors.

Turning now to FIGS. 14-17, the second embodiment of the locking assembly of the present invention is shown in detail. In this embodiment, a generally U-shaped leaf spring 80 is positioned in the housing 30. The leaf spring 80 comprises a pair of spaced-apart leaf spring portions 82, 84 connected by an arcuate bridge 86. The bridge 86 can have a U-shaped or V-shaped cross-sections and other configurations, depending on the manufacturer's preference and the strength of the leaf spring portions 82, 84.

A projection 83 is secured adjacent a free end 85 of the leaf spring portion 82. A similar projection 87 is secured adjacent a free end 88 of the second leaf spring portion 84. The free ends of the leaf spring portions 82, 84 extend between the contact members 49, 50. The projections 83 and 83 are sized and configured to extend through openings formed in the contact members 49, 50 and openings 16 and 18 formed in the prongs 12, 14, respectively.

Figure 14:
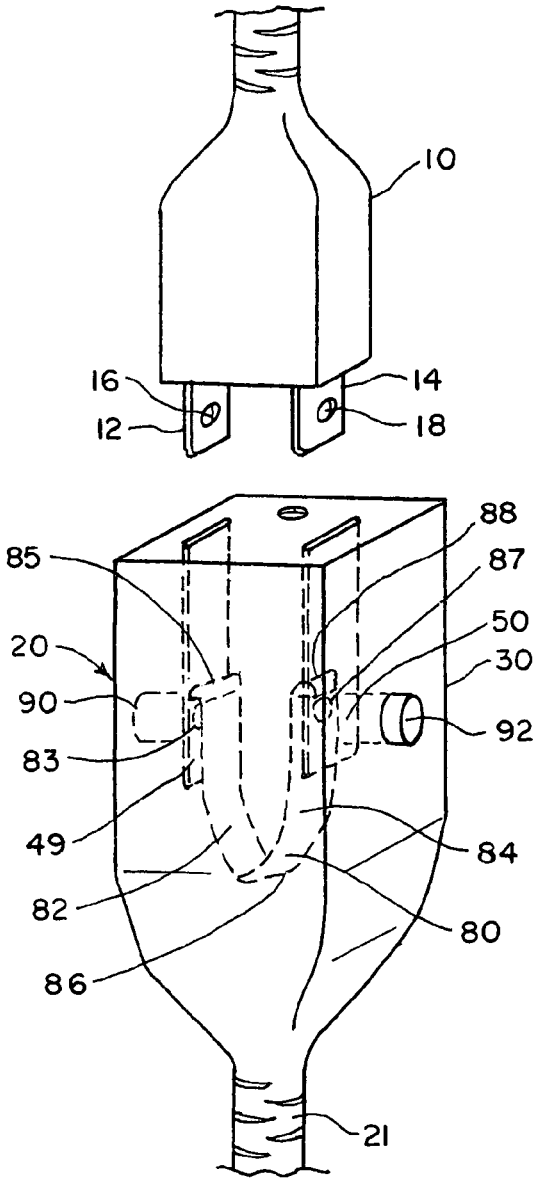
FIG. 14 is a plan view of the two connectors, with the locking device according to the second embodiment of the present invention in a locked position.
Figure 15:
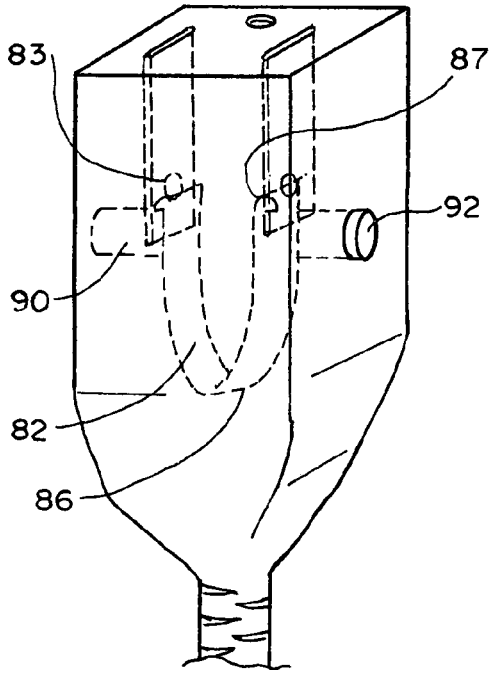
FIG. 15 is a plan view of the two connectors, with the locking device according to the second embodiment of the present invention in an unlocked position
Figure 17:
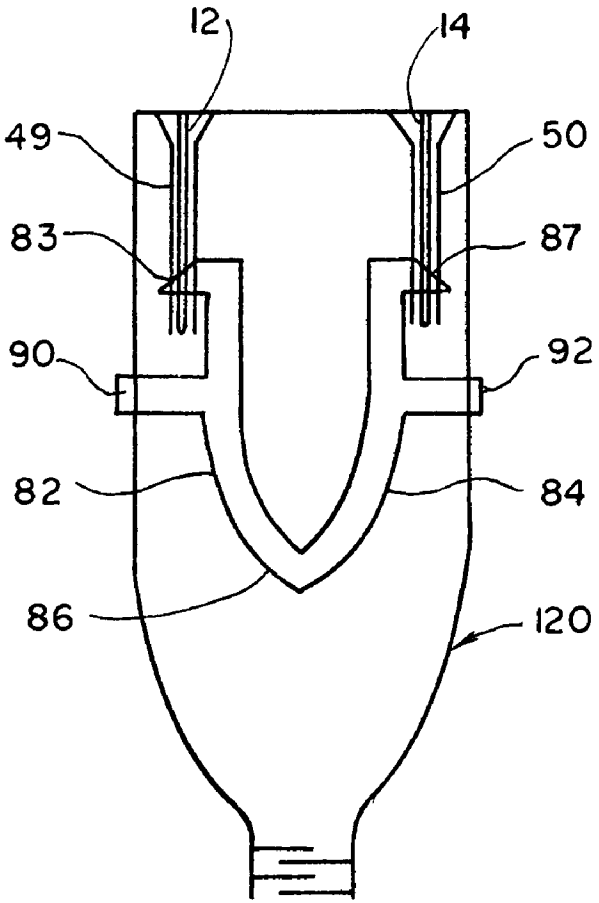
FIG. 17 is a plan view of the female receptor according to the second embodiment of the present invention in a locked position.
Figure 16:
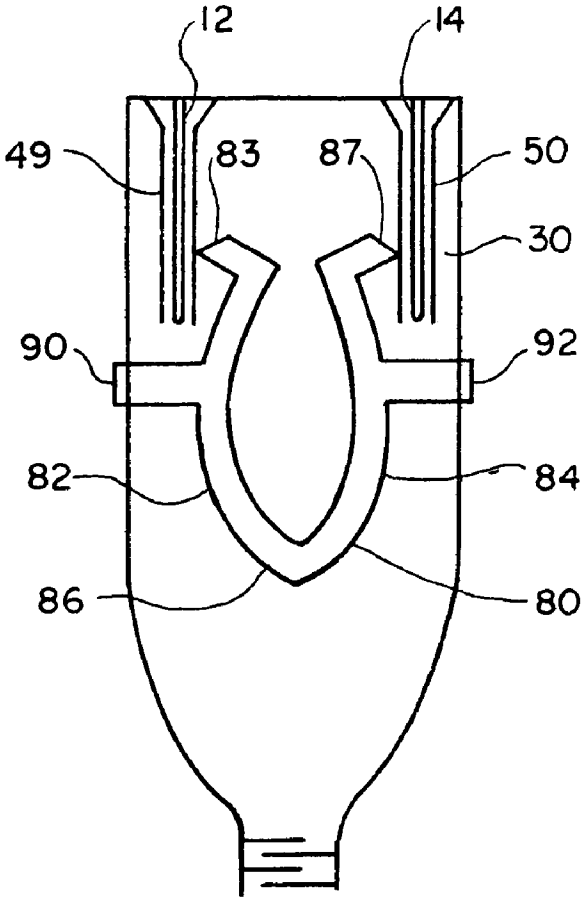
FIG. 16 is a plan view of the female receptor according to the second embodiment of the present invention in an unlocked position.

A pair of depressible actuator buttons 90, 92 is secured with the leaf spring 80, one for each leaf spring portion. The buttons 90, 92 extend in aligned relationship from the housing 30 through corresponding openings. The buttons 90 and 92 are located a distance from the projections 83, 87, approximately midway along the length of the leaf spring portions 82, 84. FIGS. 14 and 16 illustrate a normally locked position of the female receptor 20, with the projections 83 and 87 blocking insertion of the prongs 12, 14 into the slots of the female receptor 20. However, when the actuator buttons 90, 92 are depressed they push the leaf portions 82, 84 closer together, causing the free ends 85 and 88 of the leaf portions to move toward the axial center of the housing 30. In this position, the projections 83 and 87 move away from the contact member 49, 50 and open the passageway for the prongs 12, 14. The prongs 12, 14 can now be inserted into the female receptor, and the plug 10 connected to the female receptor 20.

Releasing of the buttons 90, 92 will again move the leaf portions 82, 84 apart, cause the projections 83, 87 engage with the openings in the contact members and the prongs 12, 14.

In this embodiment, similar to the second embodiment, the bridge 103 connecting the leaf spring portions 102 and 104 can be arcuate, U-shaped, V-shaped in cross section and can have other shapes.

Figure 18:
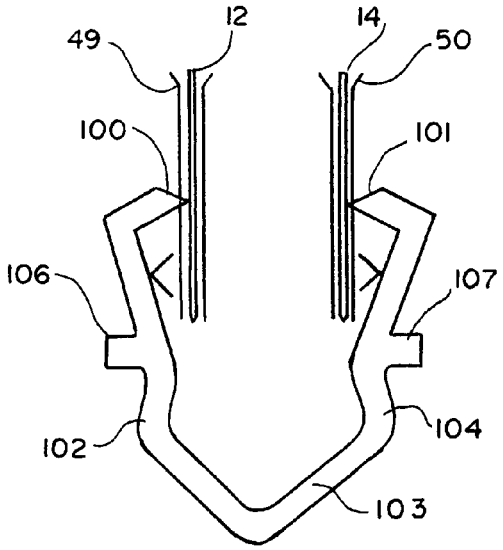
FIG. 18 is a plan view of the locking device according to the third embodiment of the present invention in an unlocked position.
Figure 19:
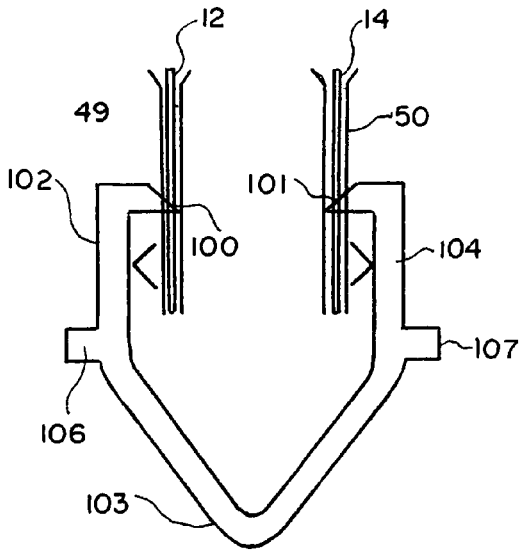
FIG. 19 is a plan view of the locking device according to the third embodiment of the present invention in a locked position

FIGS. 18 and 19 illustrate a third embodiment of the invention, wherein free ends of the leaf spring portions 102, 104 are located outside of the contact members 49, 50 and engage the openings formed in the contact members and the prongs from the outside. Each of the leaf spring portions 102, 104 is provided with a corresponding projection 100, 101.

Push buttons 106, 107 are secured to the spring leaf portions 102, 104 a distance from the projections 100, 101. In this design, when the actuator buttons 106, 107 are depressed, the projections 100, 101 are forced out of the openings in the prongs 12, 14 and the contact members 49, 50. Release of the push buttons 106, 107 causes the leaf spring portions 102, 104 to return to their normally tensed position on opposite sides of the contact members 49, 50. In this position, the projections 100, 101 enter through the openings formed in the contact members 49, 50 and the prongs 12, 14, locking the male plug with the female receptor.

Figure 20:
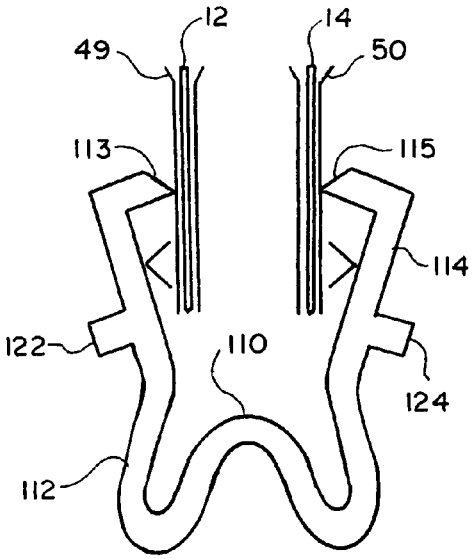
FIG. 20 is a plan view of the locking device according to the fourth embodiment of the present invention in an unlocked position.
Figure 21:
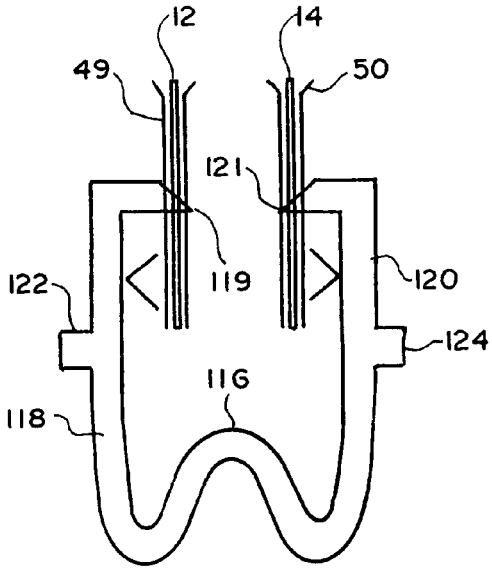
FIG. 21 is a plan view of the locking device according to the fifth embodiment of the present invention in a locked position

FIGS. 20, 21 illustrate the fourth and fifth embodiment of the invention, which is substantially similar to the third embodiment shown in FIGS. 18 and 19. However, in the fourth embodiment shown in FIG. 20, the bridge connecting leaf spring portions 112, 114 has an inverted U-shaped cross-section. In the fifth embodiment of FIG. 21, the bridge 116 connecting the leaf spring portions 118, 120 has a generally inverted V-shaped cross-section.

The operation of the locking assemblies of FIGS. 20 and 21 is substantially similar to the operation of the locking assembly illustrated in FIGS. 18 and 19. In both embodiments, pressing on the actuator buttons 122, 124 forces to leaf spring portions 112, 114 or 118, 120 to move apart, removing the projections 113, 115 (or 119, 121) from engagement with the contact members and the prongs. Releasing of the actuator buttons 122, 124 returns the leaf spring portions into their normally tensed position and allows the projections to engage with the contact members and the prongs 12, 14.

Persons having skill in the art will readily appreciate that numerous other configurations of the locking spring can be provided. Also, the locking springs can be substituted by compression springs and bars to effect the pushing action on the depressible locking buttons. Many other changes and modifications can be made in the design of the present invention without departing from the spirit thereof. We, therefore, pray that our rights to the present invention be limited only by the scope of the appended claims.

We claim:

1. A locking female electrical receptor device for use with an electrical male connector provided with electrically conductive prongs having apertures, the female receptor comprising:

a housing having an end face with slots configured to receive the prongs of the male connector;

a pair of spaced-apart electrically conductive contact members mounted in the housing in alignment with the slots, each of said contact member being provided with a channel sized and configured to receive a prong therein, each of the contact members having a transverse opening;

a locking means mounted in the housing for locking the male connector and the female receptor, said locking means being configured to move between a normally locked position extending through the openings of the contact members and an unlocked position away from the contact members, said locking means being configured to extend through apertures of the prongs when the male connector is engaged with the female receptor, wherein the locking means comprises a generally U-shaped leaf spring member having a pair of leaf spring portions connected by a bridge, each of said leaf spring portions carrying a projection adjacent a free end thereof, and wherein each of the projections is sized and configured to normally extend through the opening in the contact member; and a depressible actuator means operationally connected to the locking means for moving the locking means into an unlocked position, said actuator means comprising at least one depressible actuator button accessible from outside of the housing.

2. The device of claim 1, wherein each of the projections is configured to further extend through the aperture of the prong when the male connector is engaged with the female receptor to thereby prevent disengagement of the male connector from the female receptor.

3. The device of claim 1, wherein the actuator means comprises a pair of actuator buttons secured to the leaf spring portions and extending outwardly through corresponding openings in the housing.

4. The device of claim 1, wherein said leaf spring portions are mounted between the contact members.

5. The device of claim 1, wherein the leaf spring portions are mounted on outwardly facing sides of the contact members.

6. The device of claim 1, wherein said bridge has an arcuate configuration.

7. The device of claim 1, wherein the bridge has a generally U-shaped cross-section.

8. A locking female electrical receptor device for use with an electrical male connector provided with electrically conductive prongs having apertures, the female receptor comprising:

a housing having an end face with slots configured to receive the prongs of the male connector;

a pair of spaced-apart electrically conductive contact members mounted in the housing in alignment with the slots, each of said contact member being provided with a channel sized and configured to receive a prong therein, each of the contact members having a transverse opening;

a locking means mounted in the housing for locking the male connector and the female receptor, said locking means being configured to move between a normally locked position extending through the openings of the contact members and an unlocked position away from the contact members, said locking means being configured to extend through apertures of the prongs when the male connector is engaged with the female receptor, said locking means comprising a generally U-shaped leaf spring member having a pair of leaf spring portions connected by a bridge, each of said leaf spring portions carrying a projection adjacent a free end thereof, and wherein each of the projections is sized and configured to normally extend through the opening in the contact member; and a depressible actuator means operationally connected to the locking means for moving the locking means into an unlocked position.

9. The device of claim 8, wherein the actuator means comprises a pair of actuator buttons secured to the leaf spring portions and extending outwardly through corresponding openings in the housing.

10. The device of claim 8, wherein said leaf spring portions are mounted between the contact members.

11. The device of claim 8, wherein the leaf spring portions are mounted on outwardly facing sides of the contact members.

12. The device of claim 8, wherein said bridge has an arcuate configuration.

13. The device of claim 8, wherein the bridge has a generally U-shaped cross-section.

* * * * *